United States Patent [19]

Koch et al.

[11] Patent Number: 4,674,462

[45] Date of Patent: Jun. 23, 1987

[54] AIR SUPPLY SYSTEM FOR FUEL INJECTION SYSTEM

[75] Inventors: John W. Koch, South Perth; Sam R. Leighton, Claremont, both of Australia

[73] Assignee: Orbital Engine Co. Proprietary, Ltd., Balcatta, Australia

[21] Appl. No.: 758,898

[22] Filed: Jul. 25, 1985

[30] Foreign Application Priority Data

Jul. 25, 1984 [AU] Australia ..... PG6212/84

[51] Int. Cl.[4] ..... F02M 67/02; F02M 69/08

[52] U.S. Cl. ..... 123/533; 123/531

[58] Field of Search ..... 123/531-535

[56] References Cited

U.S. PATENT DOCUMENTS 1,868,767 7/1932 Ross ..... 123/531

4,465,050 8/1984 Igashira et al. ..... 123/533 X 4,489,701 12/1984 Simon ..... 123/531

FOREIGN PATENT DOCUMENTS 108783 2/1925 Switzerland ..... 123/531

157866 1/1922 United Kingdom ..... 123/531

*Primary Examiner*—Tony M. Argenbright

*Attorney, Agent, or Firm*—Murray and Whisenhunt

[57] ABSTRACT

An air supply system for a fuel injection system of an internal combustion engine wherein a compresosr is arranged to deliver air to the fuel injection system by an air circuit including an air chamber, and a control valve to selectively communicate the air conduit with the air chamber, the said air control valve being arranged to isolate the air chamber from the air conduit when the pressure in the air conduit falling below a predetermined pressure, and to selectively open the valve during engine start up to provide air to the circuit from the chamber.

16 Claims, 4 Drawing Figures

AIR SUPPLY SYSTEM FOR FUEL INJECTION SYSTEM

This invention relates to an air supply system for incorporation with an internal combustion engine having a fuel injection system in which compressed air is consumed.

Fuel injection systems are known wherein compressed air required in the performance of the metering and/or injection of the fuel, and thus it is necessary to provide an air system which will ensure an adequate supply of air to operate the fuel handling system at all times. Although it is convenient to provide a compressor driven by the engine as the means of supplying the compressed air, this source of air does present some problems.

Firstly it will be appreciated that without the provision of some form of a stored air supply, there is no immediately available pressurised supply of air at start-up of the engine, and the engine would therefore have to be cranked by the starter motor for a period before the compressor would supply adequate air pressure to permit the engine to start.

Although the delay in bringing the air system up to an adequate operating pressure is only small, automobile manufacturers have strict requirements in this regard.

In the event that a stored air supply is provided there remains the possibility of leakage of air during periods of non-use, and this is increased if the reservoir is permanently in communication with the complete air circuit of the injector system.

The time required to bring the air supply up to operating pressure can be reduced by maintaining the volume of the air space in the conduits and equipment, between the compressor and the injector, to a minimum. However, although this is beneficial in achieving quick start-up, it is detrimental in regard to reducing the magnitude of pulsations in the air supply. The most economic compressor construction is a reciprocating piston type, and it is desirable to keep the size of the compressor small to conserve energy consumption and manufacturing costs. This leads to only limited excess air available in the system, and together with the minimum volume in the system, gives rise to a significant pulsing of the pressure in the air system which is not conducive to stable operation of the fuel injector system.

It is therefore an object of the present invention to provide an air supply system, for fuel injection systems operable with compressed air, that overcomes or reduces the above discussed opertional problems.

With the above stated object in view there is provided according to the present invention an air supply system for a fuel injection system of an internal combustion engine comprising, a compressor adapted to be driven by the engine and to deliver air to the fuel injection system by an air conduit, an air reservoir, a reservoir valve operable to selectively connect the air reservoir to the air conduit and, control means operable when the air pressure in the conduit is below a predetermined value to close the reservoir valve to isolate the reservoir from the air conduit.

The control means is arranged to isolate the air conduit from the reservoir until the pressure in the air conduit is at a level sufficient to operate the fuel injector system under start-up conditions. This arrangement enables the pressure in the air conduit to rise more rapidly than if the reservoir was in permanent communication with the air conduit because of the lesser volume required to be pumped up to pressure by the compressor. Once the engine has been started the output of the compressor is sufficient to rapidly bring the complete air circuit, including the reservoir, up to full operating pressure.

Conveniently the reservoir valve is constructed to remain closed until the pressure in the air conduit rises to the predetermined value, which may be below the normal operating pressure of the air circuit of the fuel injector system but a pressure sufficient to effectively operate the injection system during start-up of the engine. Upon the pressure in the air conduit reaching the predetermined value, the reservoir valve will commence to open to permit air to flow into the reservoir. However, as the pressure in the air conduit is still below normal operating pressure, the reservoir valve will not open fully, and is preferably arranged to progressively increase the degree of opening thereof as the pressure in the air conduit rises above the predetermined pressure, to be fully open only when the normal operating pressure is reached.

The reservoir also increases the capacity of the air system between the compressor and the fuel injector unit, and thereby provides a damping of pressure pulses from the compressor so the pressure is substantially stead, or at least the magnitude of the pulses is significantly reduced, at the fuel injector unit.

Conveniently the reservoir may be used for the purpose of providing a stored air supply in addition to functioning as an accumulator to dampen the pressure pulsations in the air supplied by the compressor. In this arrangement the control means of the reservoir valve will be adapted to isolate the reservoir from the air supply system when the engine is not operating, and thereby reduces the risk of loss of air pressure due to leakage during relatively long periods when the engine is not operating. However, upon the initiation of the engine start-up procedure, such as upon energizing the ignition circuit of the engine, if the pressure in the reservoir is a predetermined amount above that in the remainder of the air supply system, the reservoir valve will open to provide air to the system from the reservoir and thereby raise the pressure in the air system.

Also it will be appreciated that on the termination of ignition of the engine several further revolutions of the engine will take place before it finally becomes stationary. These additional revolutions may be used to provide an extra delivery of compressed air to the reservoir by, firstly ensuring that the reservoir valve is open for a period after the ignition of the engine has been turned off, and secondly by increasing the operating pressure of air supply system and hence boost the pressure of air in the reservoir.

The control means is preferably arranged so that the reservoir valve is retained open, and the increase in the operating pressure of the relief valve applied, for a set period of time after termination of energy to the engine ignition system. After that period has elapsed the reservoir valve will close and isolate the reservoir from the rest of the air supply system, and thereafter the relief valve is returned to its normal operating pressure.

Naturally if the pressure in the air supply system, including the reservoir, falls below a predetermined value, such as through leakage in the system, the total output of air from the compressor is directed to the fuel injection system, and no air is diverted to the reservoir to build up the pressure therein. This condition will only exist for a very short period of time during and after start-up of the engine, whereafter the reservoir will be connected to the circuit so that the reserve of air can be built up therein and the pressure pulsations in the air supply reduced.

The invention will be more readily understood from the following description with reference to the accompanying drawings of various practical arrangements of the air supply system incorporating the invention.

Figure 1:
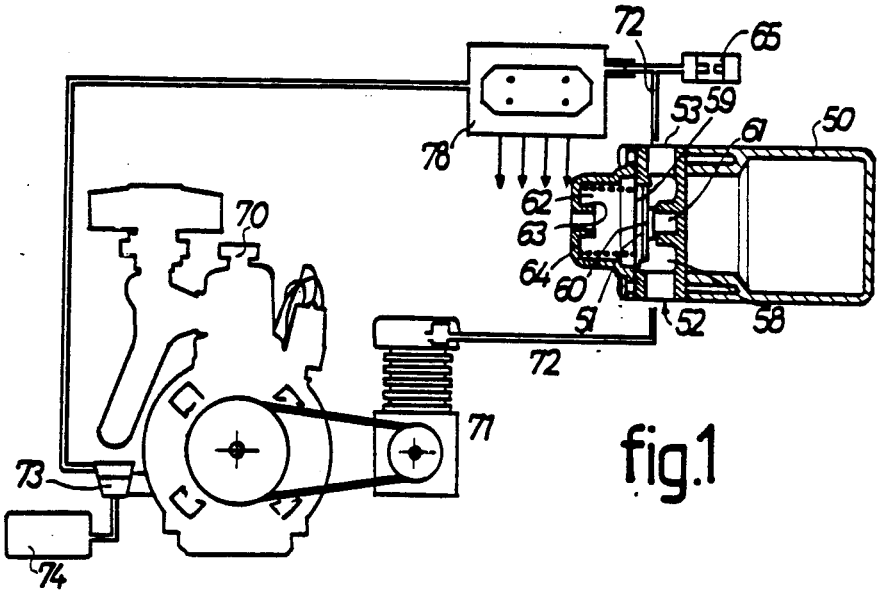
FIG. 1 is a schematic representation of one embodiment of the air supply circuit with the reservoir and control valve shown in detail in section.

Referring now to FIG. 1 of the drawings, the engine 70 is a conventional internal combustion reciprocating engine, however, the present invention may be applied to other forms of internal combustion engines and to fuel systems operating with either petrol, alcohol or diesel fuels.

The reciprocating compressor 71 is coupled by a belt drive to the crankshaft of the engine 70 so that the compressor will operate whenever the crankshaft is rotating. The fuel injection unit 78 meters and injects the fuel into the respective combustion chambers of the engine, and receives compressed air from the compressor 71 via the conduit 72, and fuel from the fuel tank 74 via the pump 73.

The chamber 50 is formed integrally with the diaphragm valve assembly 51 having inlet and outlet ports 52 and 53 connected in the conduit 72.

The diaphragm valve 51 includes the chamber 58 in constant communication with the ports 52 and 53, and having one wall thereof formed by the diaphragm 59. The valve element 60 is secured to the diaphragm 59 and co-operates with the chamber port 61 to provide selective communication between the chamber 58 and the chamber 50. The spring 62 is held in a compressed state between the diaphragm 59 and the annular shoulder 63 on the housing 64 which is vented to atmosphere.

The valve element 60 is thus urged by the action of the spring 62 and atmospheric pressure in a direction to seal the chamber port 61, while the pressure of air in the chamber 58 acting on the diaphragm 59 urges the valve element in the opposite direction to open the chamber port 61. The force applied to the diaphragm by the spring 62 is selected so that it will permit the valve element 60 to commence opening when the pressure in the chamber 58 is at a selected value below the normal operating pressure of the air supply system. This will allow a restricted flow of air into the reservoir 50 without seriously depleting the air supply to the fuel injector unit 78. In a system having an operating pressure of 550 kPa the valve may start to open at about 200 kPa.

As the pressure in the chamber 58 continues to rise, the valve element progressively moves further from the port 61 and thereby increases the flow of air into the chamber 50 until, in a short period, the chamber and reservoir pressures will equalize with the port 61 fully open.

The chamber 50 will be brought up to the system operating pressure in the order of 2 to 2½ seconds after start-up of the engine. Even so the remainder of the system is brought up to operating pressure significantly quicker than would be achieved if the chamber was in uncontrolled constant communication with the air supply from the time of initiation of engine start-up procedure.

The further advantage of the provision of the chamber 50 is that it increases the volumetric capacity of the air system between the compressor and the fuel injector unit. This increased capacity provides the ability to absorb the pressure pulses, arising from the cyclic nature of the operation of the reciprocating compressor 71, so that the pressure pulses at the fuel injection unit 78 are substantially reduced.

In an air supply system having a volumetric capacity of 200 ml including a 100 ml chamber 50, the pressure pulses at the fuel injector unit are reduced by approximately 50% when the reservoir is in communication with the remainder of the system. In this arrangement with a nominal system pressure of 550 kPa the magnitude of the pressure pulses without the chamber 50 connected is approximately 13 kPa, and with the chamber connected the pulses are reduced to approximately 6 kPa.

Figure 3:
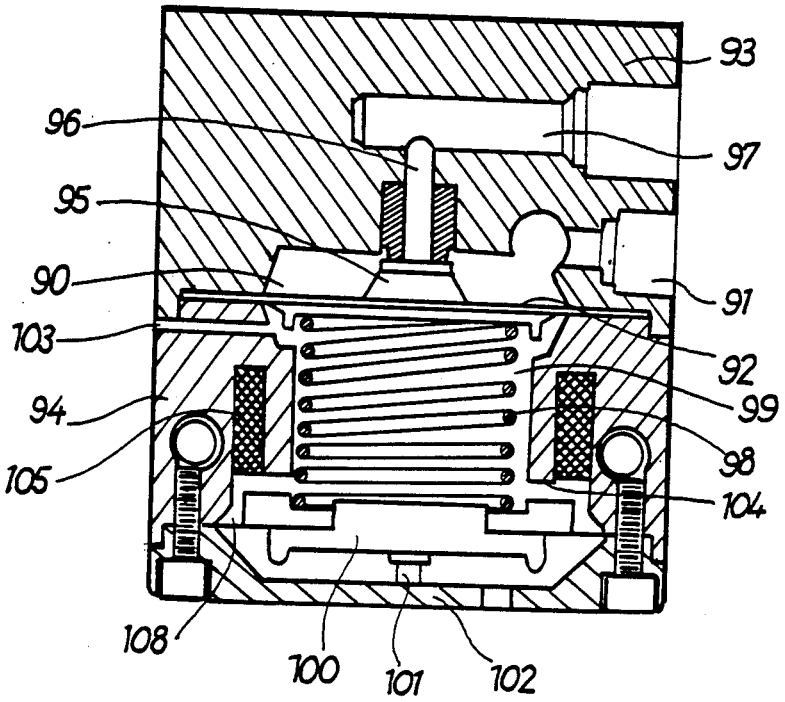
FIG. 3 is a section view of an adjustable air pressure regulator.

The air supply system incorporates a pressure regulator 65 to maintain the operating pressure at the required magnitude, and this regulator may be of a conventional construction. Alternatively the regulator may be generally as shown in FIG. 3 but without the provision for varying the regulated pressure. This construction will be described in more detail hereinafter.

Figure 2:
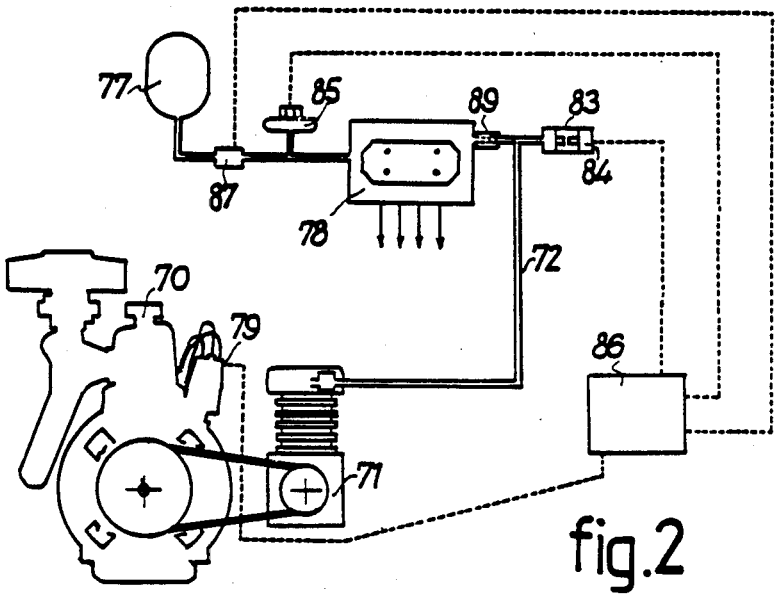
FIG. 2 is a schematic representation of a second embodiment of the air supply circuit.

Referring now to FIG. 2 which illustrates an alternative air supply. In this system many elements of the system are the same as shown in FIG. 1 and have the same reference numeral applied thereto. The system illustrated in FIG. 2 is particularly suitable for automatic vehicle application where short start times are essential, and it is desirable to hold a reserve supply of air.

In FIG. 2 the air reservoir 77 is in communication with the conduit 72, through the solenoid valve 87 and the metering unit 78, and the pressure regulator 83 is also in communication with the conduit 72.

Incorporated with the regulator 83 is a pressure adjuster 84 which may also be solenoid operated, whereby the pressure at which the regulator operates can be varied between two predetermined settings. The lower pressure of the two settings is the normal operating pressure of the air supply system.

The actual pressure in the conduit 72 is sensed by the pressure sensor 85 which is connected to the electronic controller 86 as also is the solenoid valve 87 and the regulator pressure adjuster 84.

Under steady operating conditions the compressor 71 will supply air directly to the fuel injector unit 78, and the regulator 83 will maintain a steady pressure in the conduit 72, this pressure being that arising from the lower setting of the regulator 83, which is the air system operating pressure.

When the pressure in the conduit 72 is at the normal operating pressure the sensor 85 will signal the processor 86 to open the solenoid valve 87 so that the reservoir 77 is in constant communication with the conduit 72. In this way the reservoir 77 will act as a damper on the pressure pulses derived from the reciprocating compressor 71 so as to provide a steady pressure at the fuel injector unit 78. The above described condition is that existing when the air supply system is operating under normal conditions.

The controller 86 is also connected to the ignition system 79 of the engine and arranged so that when the ignition system is turned off the regulator pressure adjuster 84 is energized and increases the relief pressure of the regulator 83. As previously explained the engine will continue to rotate for several revolutions after the ignition has been turned off, due to the inertia of the rotating components of the engine. Thus, although the ignition is turned off, the compressor will continue to operate for several strokes. While the regulator pressure adjuster 84 is energized to increase the pressure in the conduit 72, the solenoid valve 87 communicating the reservoir 77 to the conduit 72 is also held in the open position so that the pressure in the reservoir will also increase in response to the increased relief pressure.

The electronic controller 86 is arranged so that the solenoid valve 87 is held open for a predetermined time interval, measured from the termination of ignition to the engine, and then closed thus isolating the high pressure air in the reservoir from the rest of the air circuit. After the solenoid valve 87 has been closed the adjuster 84 is deactivated so that the pressure regulator 83 returns to the lower setting corresponding to the normal operating pressure of the air supply system.

When the engine is to be next started, upon the energizing of the ignition circuit of the engine, if the pressure sensor 85 detects that the air supply in the conduit 72 is below the preselected value, then the controller 86 will operate to open the solenoid valve 87 so that the high pressure air in the reservoir 77 is supplied to the conduit 72 to thus provide the fuel injection unit 78 with air at the full operating pressure. Once the engine has started, the compressor 71 will operate as the source of air to continue operation of the fuel injector unit 78, and bring the reservoir up to the same pressure as set by the regulator 83. The check valve 89 is provided in the conduit 72 between the regulator 83 and the pressure sensor 85 to prevent the flow back of air during the start-up procedure, particularly when the solenoid valve 87 is open to provide air to the system from the reservoir 77.

If, at the time of energizing the ignition circuit and after communicating the reservoir 77 with the conduit 72, the pressure in the conduit 72 as sensed by the pressure sensor 85 is below a predetermined value indicating there is little air available in the reservoir, then the controller 86 will operate to close the solenoid valve 87. Thus all of the air delivered by the compressor will be supplied directly to the fuel injection unit 78, and the pressure in the air system will come up to the value set by the regulator 83 more rapidly than if it was also necessary to bring the reservoir 77 up to operating pressure.

The controller 86 may be arranged so that the solenoid valve 87 is opened in a cyclic manner to permit small quantities of air to pass into the reservoir 77, without seriously depleting the air supply to the fuel injection unit 78. Thus the reservoir 77 is gradually brought up to the required pressure.

In a typical construction the resrvoir 77 may have a capacity from 100 to 500 ml or more. The lower figure is selected by the required degree of pressure pulsation damping and the upper one by the desired air storage capacity for engine start-up. A convenient lower figure is not less than 50% of the volume of the air system not including the reservoir, when damping is of importance.

A suitable construction for the adjustable pressure regulator, for use in the air supply system described with reference to FIG. 2, is shown in FIG. 3 of the drawings.

The adjustable pressure regulator 83 comprises an air chamber 90 connectable via the passage 91 to the air conduit 72 between the compressor 71 and check valve 89 in FIG. 2. One wall of the chamber 90 is formed by the diaphragm 92 which is clamped about its perimeter between the two sections 93 and 94 of the regulator body.

The valve element 95 is attached to the diaphragm 92 to co-operate with the bleed port 96 communicating via the passage 97 to atmosphere. The spring 98 located in the cavity 99 is in a compressed state between the diaphragm 92 and the backing plate 100 abutting the stop 101 in the end wall 102 of the regulator body. The force developed by the compressed state of the spring 98 urges the diaphragm 92 in the direction to close the part 96 by the valve element 95. The force developed by the pressure of the air in the chamber 90 urges the diaphragm 92 in the direction to open the port 96. The cavity 99 is in communication with atmosphere via the passage 103.

The backing plate 100 is supported by the flexible disc 108 for limited movement in the cavity 99 in the axial direction of the spring 98. The extent of axial movement of the backing plate 100 is limited by abutment with the stop 101 in one direction and by abutment with the annular shoulder 104 of the section 94 of the regulator body in the other direction. The electrical coil 105 located concentrically about the annular shoulder 104 forms an electro-magnet. Upon energizing the coil 105 the backing plate 100, which is made of a magnet material and functions as an armature, is displaced from the position shown in FIG. 4 to a position abutting the annular shoulder 104.

This movement of the backing plate 100 increases the degree of compression of the spring 98 and correspondingly increases the force on the diaphragm 92 holding the valve element 95 against the port 96, closing the port. Consequently the pressure of the air in the chamber 90 required to open the port 96 is raised and hence the regulated pressure of the air in air conduit 72 supplied to the fuel injector unit 78 and reservoir 77 is increased.

The energising of the coil 105 is controlled by the electronic controller 86 so that the coil is energized in response to the opening of the ingition circuit to stop the engine. The controller is arranged to maintain the coil energized for a set time interval after opening of the ignition circuit so that the regulator will remain at the higher pressure setting until the engine finally stops rotation. As previously described, this boosting of the regulator pressure as the engine is stopping will increase the pressure of the air stored in the reservoir, and so increase the air available for the next start-up of the engine.

Typically the normal regulated operating pressure of the air supply system is 500 to 600 kPa and on shut down of the engine the regulator may be adjusted to increase the regulated pressure by 150 to 250 kPa.

The regulator as above described with reference to FIG. 3 may be used in a modified form as an air pressure regulator in the system described with reference to FIG. 2. The modification would only involve the elimination of the electrical coil 105, the flexible disc 108 and the stop 101. The backing plate 100 would then abut the end wall 102 of regulator body, and the regulator would operate at a fixed regulation pressure.

Figure 4:
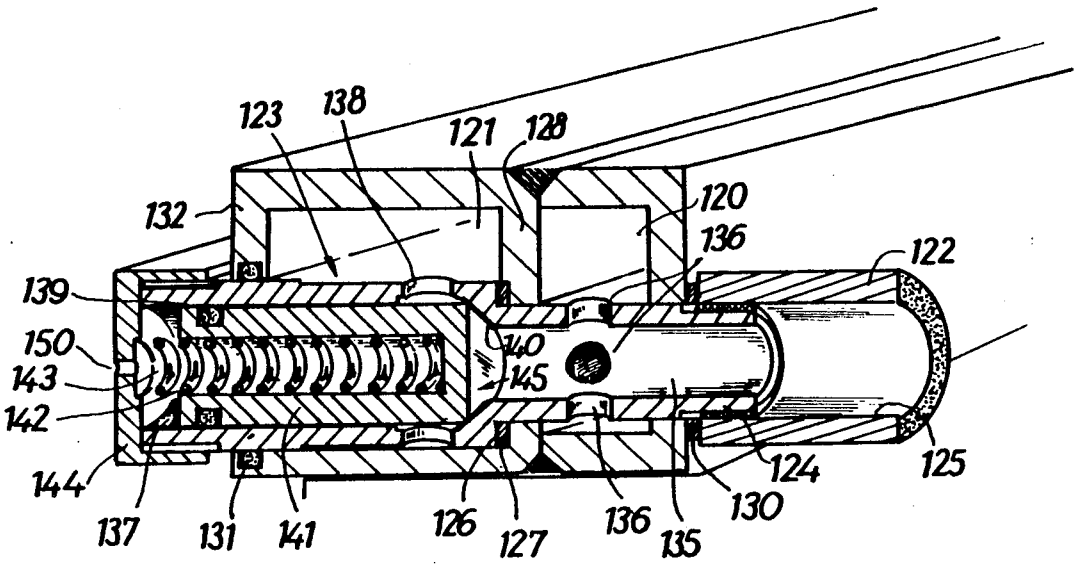
FIG. 4 is a sectioned perspective view of part of an alternative construction of the air chamber and control valve.

A further alternative form of the air chamber particularly suitable for use in multi cylinder engines employing direct cylinder injection is illustrated in FIG. 4.

In this construction the air supply conduit from the compressor is in part constituted by the tube 120 formed integral with the tube 121 which constitutes the air chamber previously referred to. The tube assembly 120,121 is disposed relative to the engine so that the injector for each cylinder may directly communicate with the tube 120 to receive air for delivery of the fuel directly into the combustion chamber of the cylinder.

One of the injectors 122 is secured to the tube assembly 120,121 by the stepped valve body 123 which is of circular cross-section. The valve body is threaded at the end 124 to engage with a thread bore 125 in the injector 122. The shoulder 126 on the body 123, through the seal ring 127, engages the internal wall 128 of the tube assembly so that the valve body 123 clamps the tube assembly to the injector. Further seal 130 is provided between the tube assembly and injector. O-ring 131 is also provided between the valve body and the wall 132 of the tube assembly.

The inner bore 135 of the valve body provides communication between the injector and the interior of tube 120 through the holes 136, and the outer bore 137 communicates with the interior of tube 121 through the holes 138. At the junction of the inner and outer bores there is provided a frusto-conical seat 140.

The valve element 141 is slidably received in the outer bore 137 with the O-ring seal therebetween. The spring 142 is compressed between the base of the cavity 143 in the valve element, and the end cap 144 of the valve body and urges the closed end 145 of the valve element into sealing engagement with the seat 140.

The aperture 150 in the cap 144 communicates that end of the outer bore with atmospheric pressure. The force applied by the spring 142 to the valve element 141 is selected so that the valve element breaks sealing contact with the seat 140 when the pressure in the tube 120 is at a pressure above atmospheric to overcome the force of the spring, that pressure being below the normal operating pressure. Air will then start to flow from the tube 120 into the tube 121 and as the pressure rises further in tube 120, the valve element 141 will progressively open further until, at normal operating pressure in the tube 120, the valve element is fully open. The tubes 120 and 121 will then be balanced.

As previously indicated, the tube 121 functions as the air chamber 50 referred to in relation to FIG. 1 and performs the same function thereas to provide a minimum volume air system during engine start-up, that may be increased as the system comes up to operating pressure to provide damping of pressure pulses raising from the reciprocating compressor supplying the air.

In the construction as shown in FIG. 4, the valve body 123 and associated components of the above described construction may be used to connect each injector to the air supply constituted by the tube assembly 120,121, or such a valve body may be used to connect only one of the series of injectors. In the latter alternative the other injectors are connected to the tube assembly by a component externally similar to the valve body but not incorporating the outer bore 137, holes 138 or valve element 141.

In one construction in accordance with FIG. 4 the volumetric capacity of the air system up to and including the tube 120 is 100 ml and that of tube 121 is also 100 ml. The construction will provide substantial damping of the pressure pulses in the air system.

The claims defining the invention are as follows.

We claim:

1. An air supply system for a fuel injection system of an internal combustion engine including a compressor, an air conduit communicating the compressor to the fuel injection system to deliver air from the compressor to the fuel injection system, an air chamber, an air control means operable to selectively communicate the air conduit with the air chamber without interrupting the air delivery to the fuel injection system, said air control means being adapted to isolate the air chamber from the air conduit in response to the pressure in the air conduit falling below a predetermined pressure.

2. An air supply system as claimed in claim 1 wherein the air control means is a valve adapted to commence opening as the pressure in the air conduit rises above said predetermined pressure and to progressively increase the area of the flow path through said valve as the pressure in the air conduit rises through a range above said predetermined pressure.

3. An air supply system as claimed in claim 1 wherein the air control means is a valve actuated by electrical means and a pressure switch to control the energizing of said electrical means, said switch being arranged to be responsive to the pressure in the air conduit to close the air control valve when the pressure in said conduit is below said predetermined pressure.

4. An air supply system as claimed in any one of claims 1, 2, or 3 wherein the volumetric capacity of the air chamber is not less than 50% of the total volumetric capacity of the balance of the air supply system between the compressor and the fuel injection system.

5. A fuel injection system of an internal combustion engine and an air supply system to provide air to the fuel injection system, said air supply system comprising a compressor adapted to be driven by the engine and to deliver air to the fuel injection system by an air conduit, an air reservoir, a reservoir valve operable to selectively connect the air reservoir to the air conduit without interrupting the air delivery to the fuel injection system, and control means operable in response to a pressure in the conduit below a predetermined pressure to close the reservoir from the air conduit.

6. A fuel injection system as claimed in claim 5 wherein the reservoir valve is electrically actuated, and the control means includes a sensor means subject to the pressure in the air conduit, and switch means to control the supply of electrical energy to said reservoir valve and adapted to actuate in response to said sensor means detecting the pressure in said air conduit is below said predetermined pressure to close said reservoir valve.

7. A fuel injection system as claimed in claim 5 or 6 including an adjustable relief valve to set a normal operating pressure in the air conduit, and the control means are operable in response to termination of ignition to the engine to;

adjust the relief valve to open at a higher pressure than the said operating pressure, and retain the reservoir valve open for a period after termination of ignition to the engine.

8. A fuel injection system as claimed in claim 5 or 6 including an air pressure regulator adjustable between a first and a higher second relief pressure, said regulator being controlled to normally operate at said first pressure and in response to termination of operation of the engine to operate at said second pressure.

9. A fuel injection system as claimed in claim 8 wherein the regulator is controlled to operate at said second pressure for a selected time interval from termination of operation of the engine.

10. An air supply system as claimed in claim 9 wherein the regulator is controlled to switch from said first pressure to said second pressure in response to termination of ignition for said engine.

11. A method of supplying air to a fuel injector which injects a mixture of fuel and air to an internal combustion engine, the method comprising providing air from an air compressor to the injector through a conduit selectively communicating the air conduit with an air chamber through an air control means, and operating said air control means in response to the pressure in the air conduit falling below a predetermined pressure to isolate the air conduit from the air chamber without isolating the compressor from the injector.

12. A method as claimed in claim 11 wherein the air control means commences to provide a restricted air flow to the air chamber as the pressure in the air conduit rises above said predetermined pressure and progressively reduces the restriction to the air flow as the pressure in the air conduit rises through a range above said predetermined pressure.

13. A method of supplying air to a fuel injector which injects a mixture of fuel and air to an intermittently operated interval combustion engine, said method comprising supplying air from an air compressor through a conduit to the injector while the engine is running, with the conduit being in open communication with an air chamber, and isolating the air chamber from the conduit without isolating the compressor from the injector upon start-up of the engine until the air pressure in the conduit reaches a predetermined value.

14. A method as claimed in claim 13, wherein the air chamber is isolated from the conduit when the engine is not running.

15. A method as claimed in claim 14, wherein upon termination of ignition of the engine several further engine revolutions occur, and the conduit is in open communication with the air chamber during at least the initial portion after ignition termination.

16. A method as claimed in claim 15, wherein during at least said initial portion after ignition termination the pressure in the conduit is increased to increase the air pressure in the air chamber.

* * * * *